US006488593B2

(12) United States Patent
Imahata

(10) Patent No.: US 6,488,593 B2
(45) Date of Patent: Dec. 3, 2002

(54) GAME APPARATUS HAVING A SPHERICAL OBJECT DROP MECHANISM

(76) Inventor: Takeo Imahata, 7390 Woodsboro Ave., Anaheim, CA (US) 92807

( * ) Notice: Subject to any disclaimer, the term of this patent is extended or adjusted under 35 U.S.C. 154(b) by 0 days.

(21) Appl. No.: 09/870,229

(22) Filed: May 30, 2001

(65) Prior Publication Data

US 2002/0082107 A1 Jun. 27, 2002

Related U.S. Application Data

(63) Continuation-in-part of application No. 09/538,116, filed on Mar. 29, 2000, now Pat. No. 6,440,007.

(51) Int. Cl.[7] ..... A63B 57/00; B65G 59/00

(52) U.S. Cl. ..... 473/282; 221/264; 221/295

(58) Field of Search ..... 221/12, 152, 194, 221/276, 295, 31 RR, 264, 265; 473/132, 137, 282, 286

(56) References Cited

U.S. PATENT DOCUMENTS

| | | | | | |
|---|---|---|---|---|---|
| 3,894,657 | A | * | 7/1975 | Eckmayr | 221/265 |
| 4,216,878 | A | * | 8/1980 | Naud | 221/264 |
| 5,009,330 | A | * | 4/1991 | Young et al. | 221/196 |
| 5,147,101 | A | * | 9/1992 | Tiller | 221/199 |
| 5,806,122 | A | * | 9/1998 | Bogle et al. | 15/21.2 |
| 5,996,839 | A | * | 12/1999 | McLinn | 221/174 |
| 6,189,732 | B1 | * | 2/2001 | Althaus et al. | 221/155 |

* cited by examiner

*Primary Examiner*—Stephen Blau
(74) *Attorney, Agent, or Firm*—Muramatsu & Associates

(57) ABSTRACT

A spherical object drop mechanism for a game apparatus has a mechanism allowing to drop spherical objects one by one on the desired position on the ground. The spherical object drop mechanism includes a ball guide to store a plurality of spherical objects movable in vertical direction by gravity, an upper housing provided at an upper portion of the ball guide, a lower housing provided at a lower portion of the ball guide, a ball stopper ring to stop and release the movement of the spherical object in the vertical direction, a drive part to transmit the movement to the ball stopper ring, and a lever to operate the drive part from outside.

15 Claims, 12 Drawing Sheets

GAME APPARATUS HAVING A SPHERICAL OBJECT DROP MECHANISM

This application is a continuation-in-part of the U.S. patent application Ser. No. 09/538,116, filed on Mar. 29, 2000, now U.S. Pat. No. 6,440,007 entitled "Game apparatus having spherical object drop mechanism."

FIELD OF THE INVENTION

This invention relates to a mechanism to drop an object freely. More particularly, this invention relates to a mechanism to drop a spherical object to an arbitrary location on the ground in a simple manner, which is suitable for a golf club or a similar game apparatus.

BACKGROUND OF THE INVENTION

Men and women of all ages are enjoying the game of golf these days. Golf is a game to hit the ball having a diameter of about 4 cm (centimeter) on the ground with a lesser number of strokes to put the ball in a hole or cup on the green.

The game of golf can be roughly classified in its play into a process of placing the ball onto a green where a hole is provided, and a process of putting for hitting the ball on the green with a putter to bring the ball into the hole.

The practice of putting purports to put the ball, or a spherical objected placed on the ground into a hall. The putting is also enjoyed for its own sake as recreation. This invention is directed to a game apparatus which is similar to a golf putter, although it is not limited to the putter. However, for the convenience of explanation, the following description is made based on the golf putting.

When a player practices putting or plays putting as recreation, the player has to place balls on the ground (placement process). Hence, in order to practice putting ten (10) times, for example, the player has to place the ball ten times. To repeat such a simple routine of placing the ball is boring and frustrating. Moreover, bending down to place a ball on the ground may pose significant difficulty for an elderly player or a player with a back pain. When a player practices putting with many balls, the player has to carry a container storing many balls such as a bag.

Thus, it is desired to achieve means for easily and automatically placing the balls on the ground without a player's action to bend over the ground to place the balls. A possible apparatus to achieve this objective can be classified into two, an apparatus mounting a spherical object drop mechanism to a club, and an apparatus having a spherical object drop mechanism separately from the golf club.

If the apparatus to mount the spherical object drop mechanism independently from a golf club is to be used, the apparatus having the spherical object drop mechanism needs to be brought over with a player in addition to golf clubs. Moreover, when the spherical object drop mechanism is large, it must be fixed to a specific location on the ground and thus, the ball must be placed only on the same position.

For the apparatus to mount spherical object drop mechanism to a golf club is to be used, it is conceivable to place a ball on the ground with an electric powered mechanism. However, such a structure becomes complex, expensive and inconvenient since an electric power supply such as a battery must be used.

Thus, it is desirable to have a mechanism that allows ball placement on the desired position on the ground by mechanical means with simple structure and low cost.

Moreover, the user need to carry the spherical object drop mechanism if such a mechanism is provided to the golf club. When the balls are stored in the spherical object drop mechanism, rough handling or careless tilting or dropping of the spherical object drop mechanism may cause the balls to fall out. Thus, it is desired to establish a means to prevent the balls from falling out from the mechanism.

SUMMARY OF THE INVENTION

Therefore, it is an object of the present invention to provide a mechanism to drop and place a spherical object on the ground for use with a golf putter or a game apparatus similar to a golf putter.

It is another object of the present invention to provide a mechanism to mechanically drop and position a spherical object for a game such as a golf ball on the ground with a simple configuration.

It is a further object of the present invention to provide a ball game apparatus which integrally includes a spherical object drop mechanism and a ball storage where the drop mechanism is to drop a spherical object for a game such as a golf ball on the ground by a simple and inexpensive configuration.

It is a further object of the present invention to provide a spherical object drop mechanism which is able to prevent spherical objects for a game such as golf balls from falling out from the drop mechanism with use of a simple and inexpensive configuration.

The spherical object drop mechanism for game apparatus of the present invention has the mechanism to drop spherical objects one by one on the desired location of the ground. In one aspect of the present invention, the spherical object drop mechanism is comprised of:

a ball guide for storing a plurality of spherical objects in a manner to move in a vertical direction with their own weight;

an upper support provided to an upper portion of the ball guide;

a lower housing provided to a lower portion of the ball guide;

a ball stopper ring provided in the lower housing for stopping or releasing the vertical movements of the spherical objects;

a drive part for driving the ball stopper ring in stopping and releasing the spherical objects; and a lever to operate the drive part from outside.

The spherical object drop mechanism for game apparatus of the present invention is able to drop the ball one by one to the ground. Since the spherical object drop mechanism of the present invention has a simple configuration, it can achieve high reliability, ease of production, and less needs of maintenance. Accordingly, it is able to produce the spherical object drop mechanism of the present invention at low cost, light-weight, and strong.

DETAILED DESCRIPTION OF THE INVENTION

The spherical object drop mechanism for game apparatus of the present invention can be carried around with a plurality of spherical objects (such as golf balls) stored therein. Moreover, the user can drop the spherical objects such as golf balls on the desired locations of the ground by operating the lever of the drop mechanism.

Figure 1A:
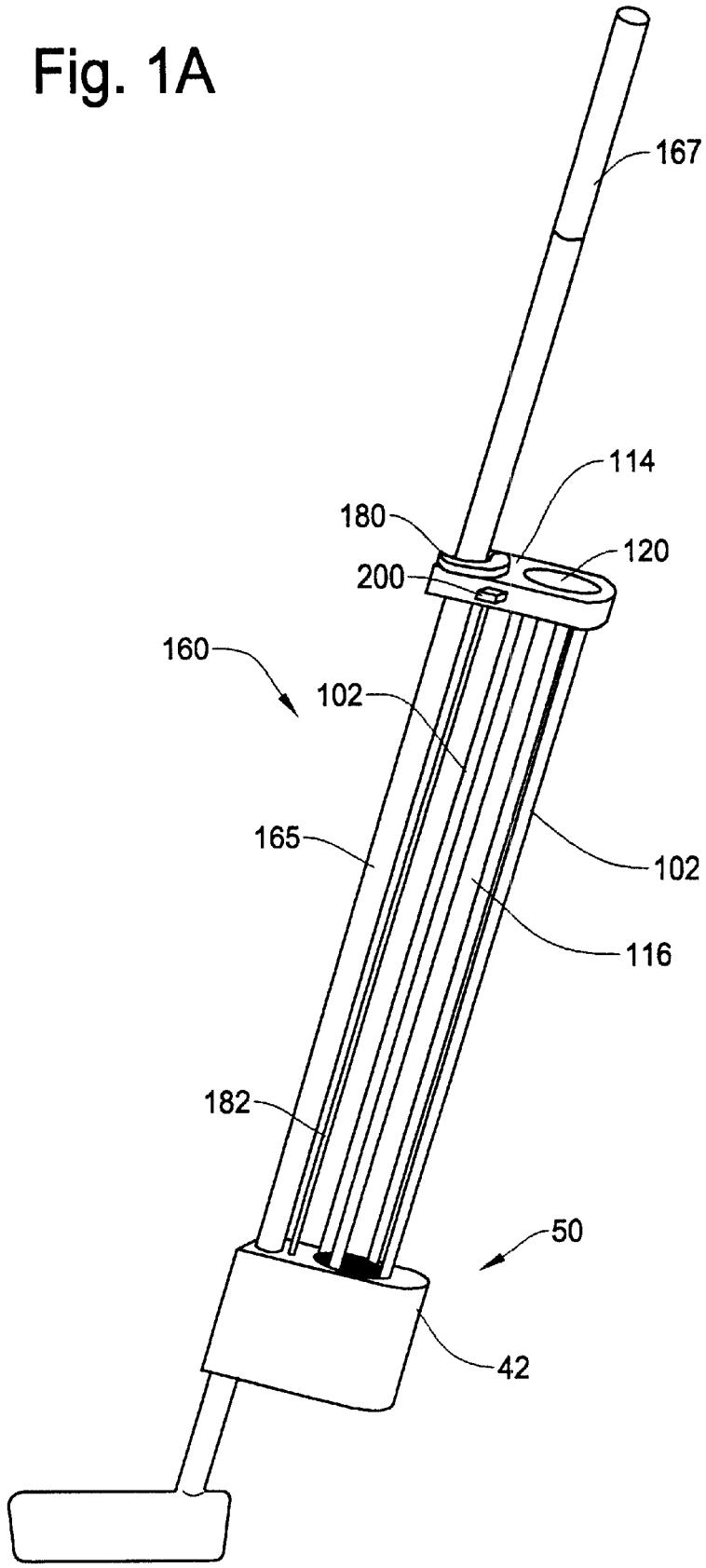
FIG. 1A is a perspective view showing an overall outside appearance of the game apparatus of the present invention wherein the spherical object drop mechanism is attached to a golf club.

The spherical object drop mechanism for game apparatus of the present invention attached to a golf club is explained with reference to FIG. 1A. In the example of FIG. 1A, the spherical object drop mechanism 50 for game apparatus of the present invention is attached to a golf club 160 such as a putter. The spherical object drop mechanism 50 is attached to a shaft 165 of the golf club 160 through, for example, screws. The spherical object drop mechanism 50 of the present invention has an upper support 114 at its upper portion thereof, a lower housing 42 at its lower portion, and a ball guide (ball storage) 102 in the middle.

The upper support 114 has a ball insertion opening 120 for a user to insert a ball therethrough. On the upper support 114, a lever 180 is provided to be operated by a user to drop a ball on the ground. Moreover, on the upper support 114, a lock bar 20 is provided to prevent the balls from dropping out from the ball insertion opening 120.

The ball guide 102 stores balls, and directs the balls to the lower housing 42 by the weight of the balls. The ball guide 102 forms a ball passage cylinder 116 for the balls to pass therethrough. Although not specifically shown in the drawings, the ball passage cylinder 116 functions to store a large number of balls.

The spherical object drop mechanism 50 for a game apparatus of the present invention has a drive part (shaft) 182 that extends from the upper support 114 to the lower housing 42. The drive part 182 functions to transmit the rotational movement of the lever 180 to the ball stopper ring 46 (not shown in FIG. 1A) in the lower housing 42. The construction and the movement of the lever 180, the drive part 182, and the ball stopper ring 46 will be explained later in detail.

Figure 1B:
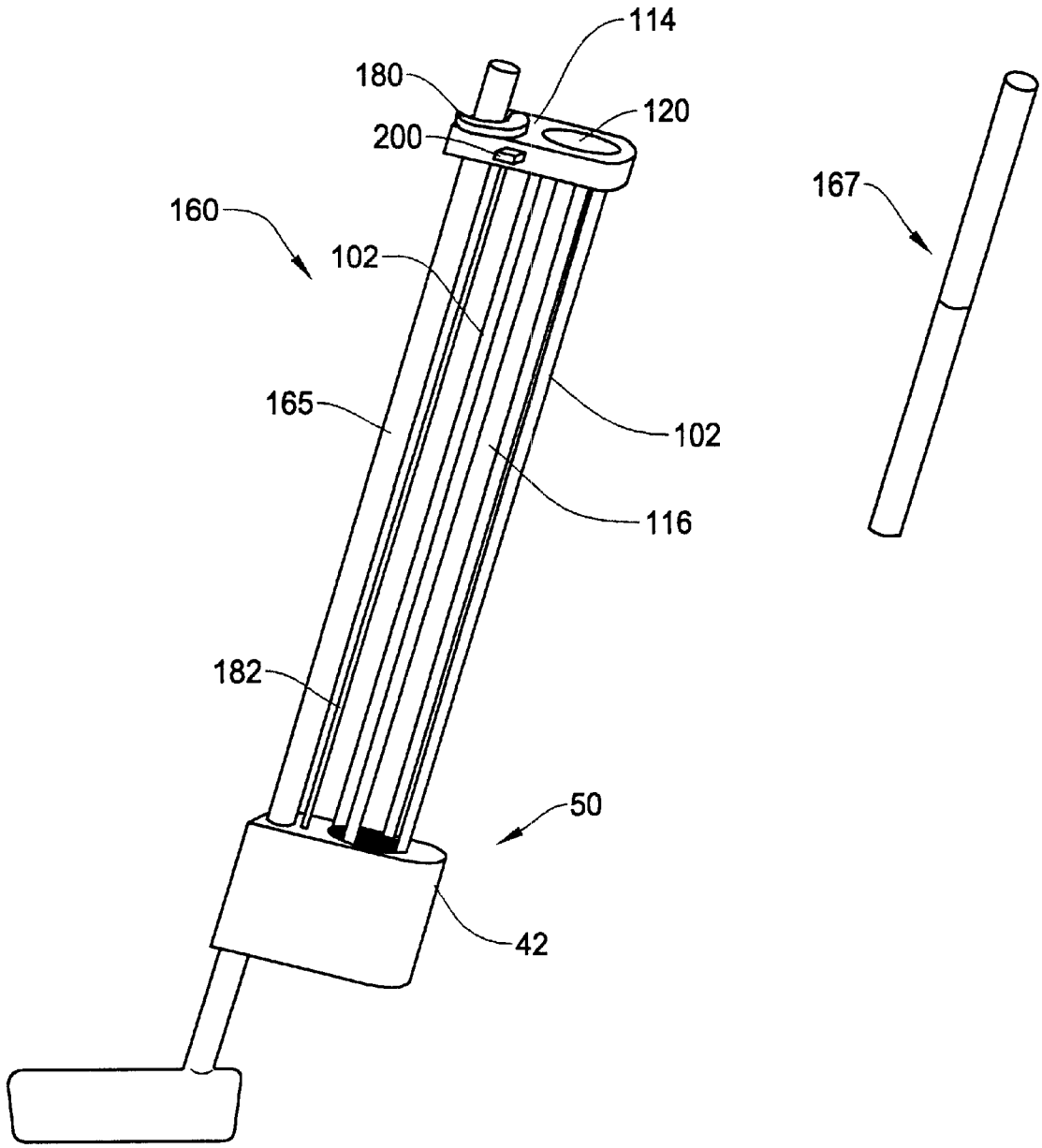
FIG. 1B is a perspective view showing an outer appearance of the spherical object drop mechanism of present invention wherein the grip part of the golf club is removed for easy carrying around.

FIG. 1B shows an example wherein the upper part 167 of the club including the grip is disconnected from the shaft 165 for easy carrying around. The golf club or a similar game apparatus may be either a commercially available club or a specially made club for the drop mechanism 50. By reducing the length of the club as shown in FIG. 1B, the user can more easily and conveniently carry around the spherical object drop mechanism 50 for game apparatus of the present invention.

Figure 1C:
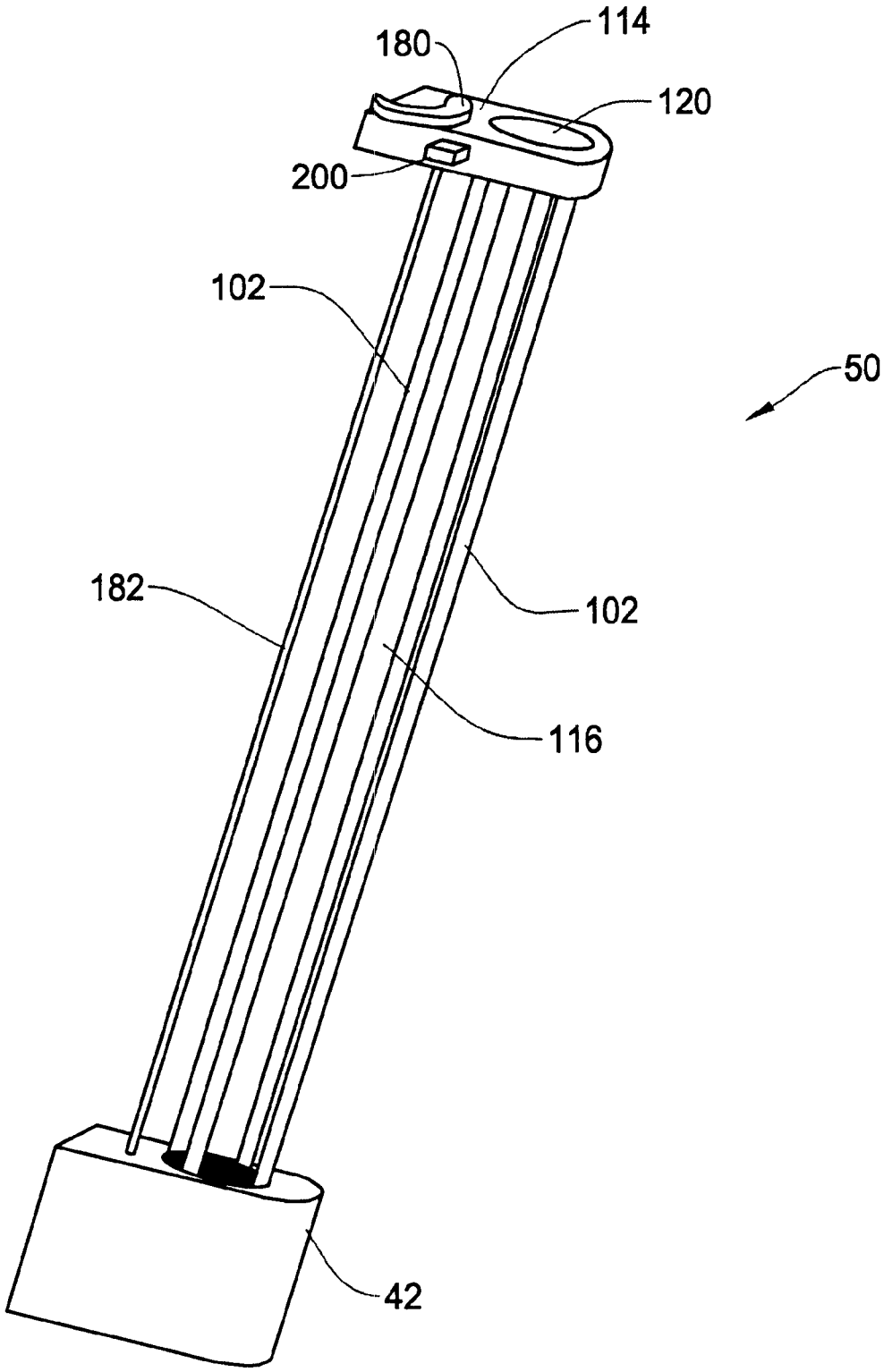
FIG. 1C is a perspective view showing an outer appearance of the spherical drop mechanism of the present invention which is removed from the golf club.

FIG. 1C shows the spherical object drop mechanism 50 for game apparatus of the present invention which is detached from the golf club. The configuration in FIG. 1C is identical to that shown in FIG. 1A and FIG. 1B except that the spherical object drop mechanism 50 is disconnected from the club. Since the spherical object drop mechanism 50 for game apparatus of the present invention is detachable by a user, it can be freely attached to a specially made club or a commercially available club.

The basic configuration and operation of the spherical object drop mechanism 50 for game apparatus of the present invention is explained with reference to FIG. 2 to FIG. 6. As described above, the spherical object drop mechanism 50 can store a plurality of spherical objects, such as golf balls, and the user can drop the balls onto desired spots on the ground by operating the lever.

Figure 2:
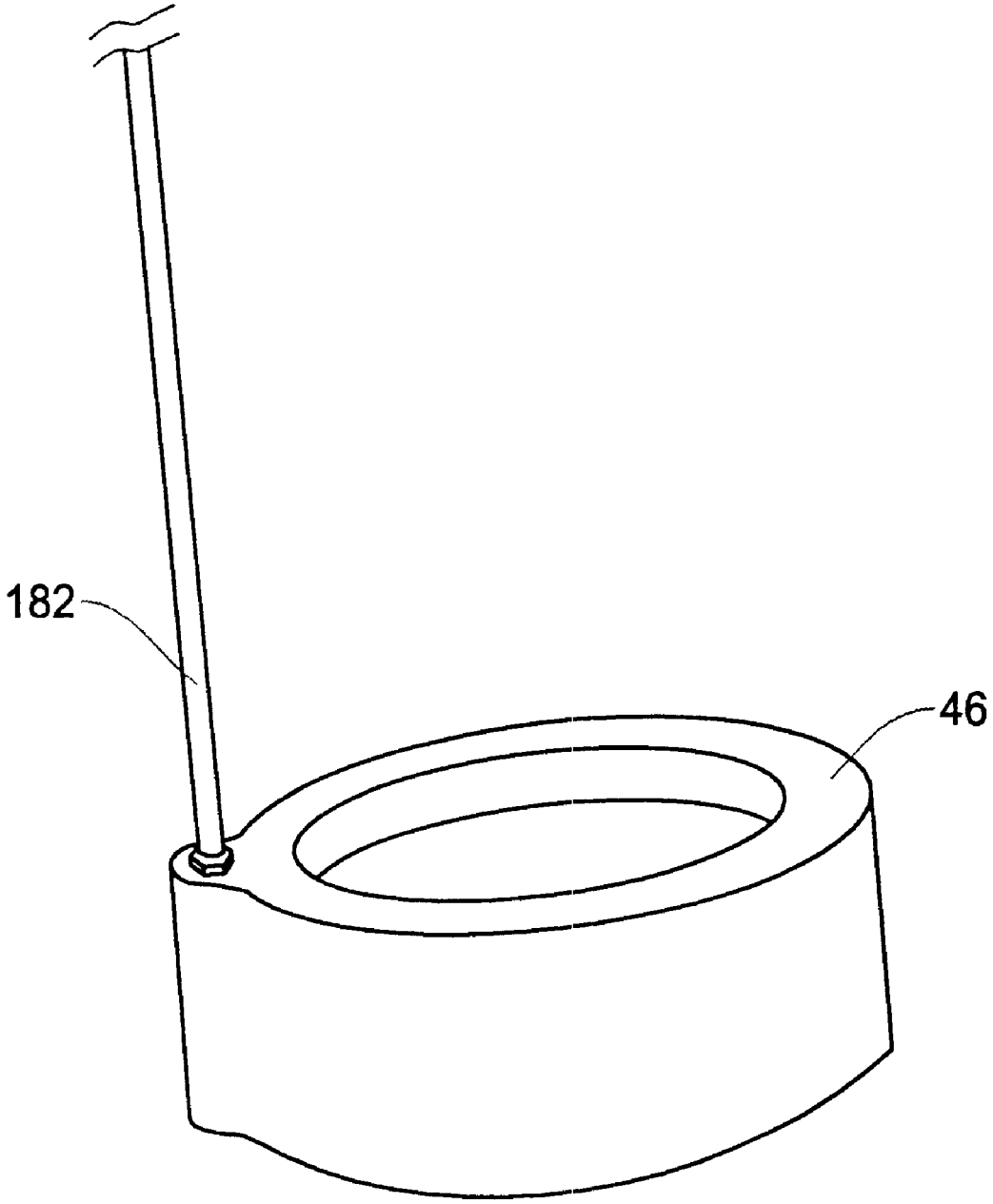
FIGS. 2 is a perspective view of the driving part and the ball stopper ring of the spherical object drop mechanism for game apparatus of the present invention.

FIG. 2 is a perspective view of the drive part (shaft) 182 and the ball stopper ring 46 installed in the spherical object drop mechanism for game apparatus of the present invention. In the actual use, the ball stopper ring 46 is provided in the lower housing 42. As shown in the drawings, the ball stopper ring 46 and the drive part 182 are connected with each other. Thus, the movement of the drive part 182 is transmitted to the ball stopper ring 46.

Figure 3A:
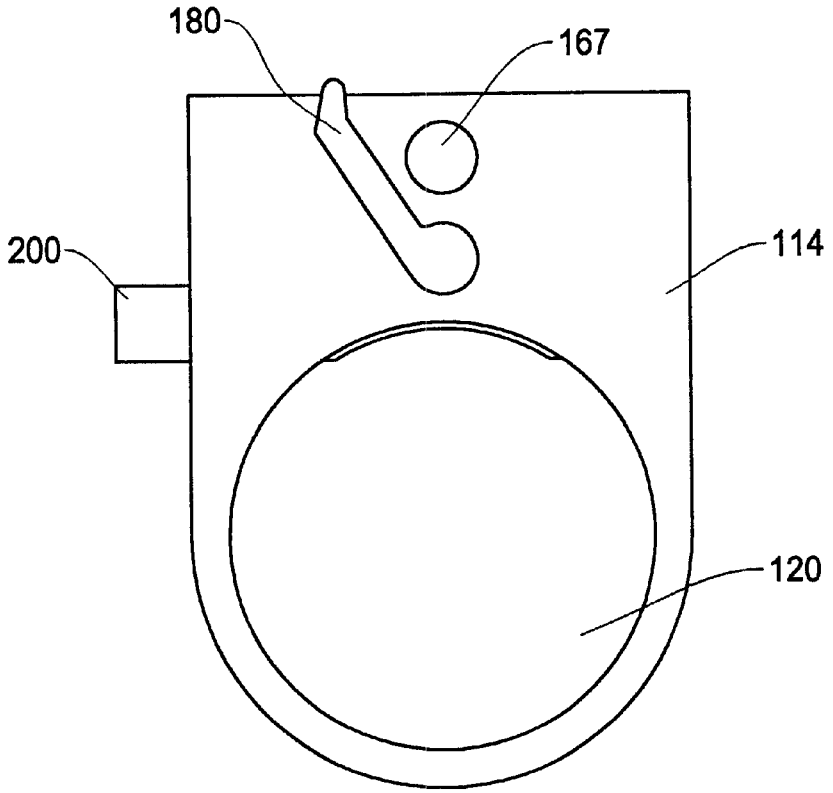
FIG. 3A and FIG. 3B are schematic diagrams showing the lever used in the spherical object drop mechanism for game apparatus of the present invention.
Figure 3B:
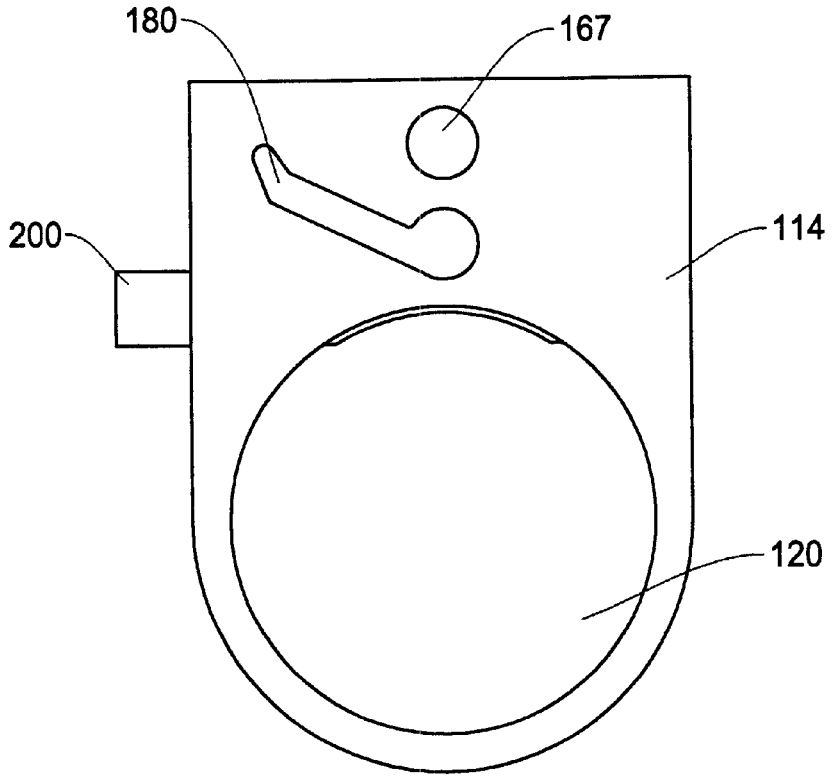

Both FIGS. 3A and 3B are top views showing the operation of the lever installed on the upper support 114 of the spherical object drop mechanism 50 for game apparatus of the present invention. The shaft support hole 167 is provided on the upper support 114. The shaft support hole 167 is provided to attach the upper support 114 to the golf club, and is not directly related to the operation of the spherical object drop mechanism 50 of the present invention. The lock bar 200 and the ball insertion opening 120 are provided to the upper support 114 wherein the lock bar 200 is positioned so as to open the ball insertion opening 120. The details of the lock bar 200 is explained later.

The lever 180 attached in a manner rotatable. Thus, when the user operates the lever 180, the rotational movement of the lever is created about its shaft. In this example, the lever 180 is positioned at the left side of the shaft support hole 167, thus, this lever is provided conveniently for left-handed users. It is also possible to position the lever 180 to be convenient for right-handed users by attaching the lever 180 to the right side of the shaft support hole 167 by rotating about 90 degrees from that shown in the drawing.

The drive part 182 is extended downwardly from the lever 180 and is connected to the ball stopper ring 46 as shown in FIG. 2. Thus, the rotational movement of the lever 180 is transferred to the ball stopper ring 46. As a consequence, as described in detail later, the ball stopper ring 46 rotates about its shaft (drive part 182).

FIG. 3A shows the condition wherein the user is not operating the lever 180. In this condition, the balls will not drop from the drop mechanism. FIG. 3B shows the condition where the user moves the lever 180. In this condition, the movement of the lever is transmitted to the drive part 182, and the movement of the drive part 182 is further transmitted to the ball stopper ring 46 in the lower housing 42, thereby dropping the balls.

Figure 4A:
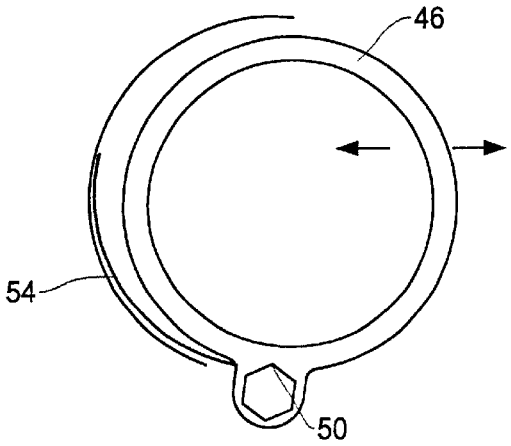
FIG. 4A and FIG. 4B are schematic diagrams showing the operation and its positional relationship of the ball stopper ring in the spherical object drop mechanism for game apparatus of the present invention.
Figure 4B:
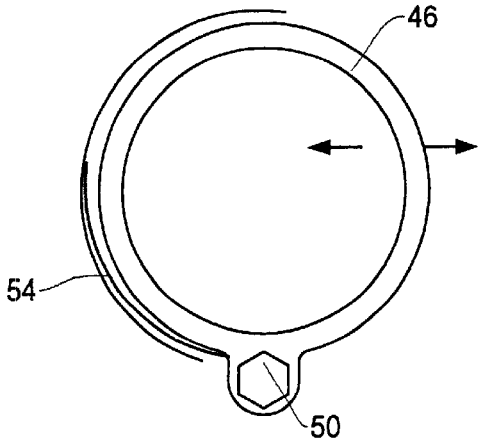
Figure 5A:
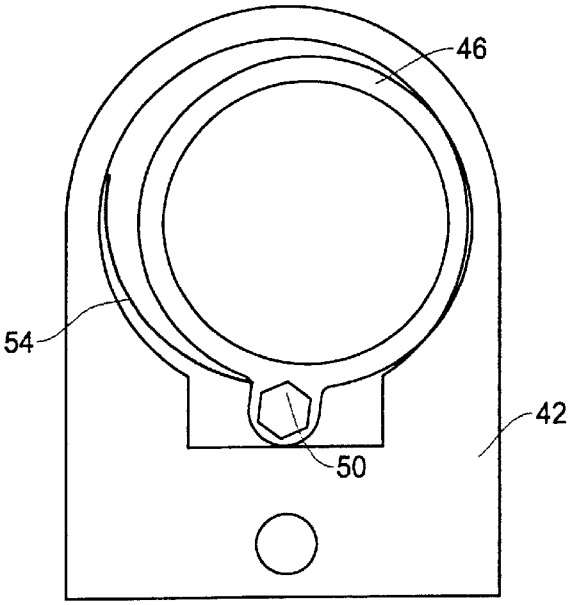
FIG. 5A and FIG. 5B are schematic diagrams showing the operation and its positional relationship of the ball stopper ring stored in the lower housing in the spherical object drop mechanism for game apparatus of the present invention.
Figure 5B:
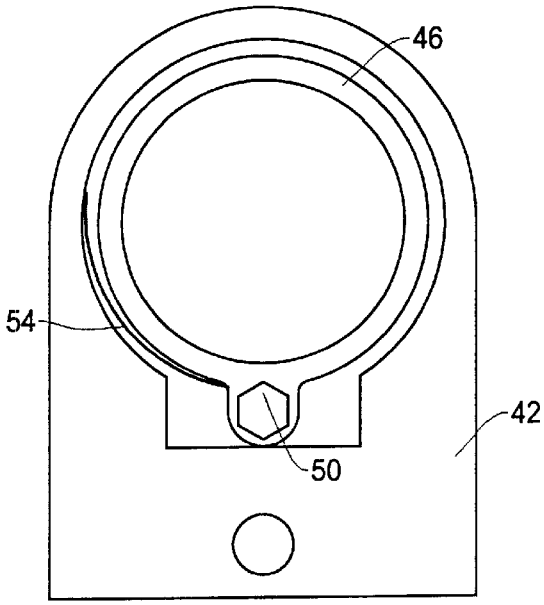

FIGS. 4A and 4B, and FIGS. 5A and 5B show the positional relationship between the ball stopper ring 46 and the lower housing used in the spherical object drop mechanism 50 for game apparatus of the present invention. FIGS. 4A and 4B schematically show the movements of the ball stopper ring 46. FIGS. 5A and 5B show the movements of the ball stopper ring 46 within the lower housing 42.

In FIG. 4 and FIG. 5, the bolt 50 has a center which is rotatably connected to the drive part 182 and the ball stopper ring 46. Thus, the rotational movements generated when the user operates the lever 180 is transmitted to the ball stopper ring 46 through the drive part 182. The internal diameter of the ball stopper ring 46 is designed to be slightly larger than the external diameter of the ball so that the ball can pass therethrough.

The spring 54 is provided to the ball stopper ring 46. The spring 54 is designed so as to return the ball stopper ring 46 to the original position when the user releases the lever 180.

FIG. 4A and FIG. 5A respectively show the condition where the lever 180 is not operated. In this condition, the balls are stored in the ball drop mechanism 50 and are not dropped from the drop mechanism. This condition corresponds to those in FIG. 3A described above and FIG. 6A to be described later. On the other hand, FIG. 4B and FIG. 5B show the situation where the lever 180 is moved by the user. In this condition, the ball drops from the drop mechanism. This condition corresponds to those in FIG. 3B described above and FIG. 6C to be described later. In an actual application, there is a further situation where the lowermost ball drops within the lower housing 42 through the stopper ring 46 but will not drop from the lower housing 42 as shown in FIG. 6B. This condition will be explained later.

First, the condition is explained wherein the lever is not operated, that is, the ball is maintained in the lower housing 42. As shown in FIGS. 4A and 5A, the ball stopper ring 46 is not positioned at the center but is positioned close to either one of the sides of the lower housing due to the spring force of the spring 54. Thus, the center of the ball stopper ring 46 and the center of the lower housing 42 do not match, which makes an overall size of the ball passage smaller than an outer diameter of the ball. Accordingly, the ball cannot drop because it touches the upper shoulder of the ball stopper ring (FIG. 6A).

When the lever 180 is moved, as shown in FIG. 4B and FIG. 5B, the force is applied to the ball stopper ring 46 against the spring 54, and the center of the ball stopper ring is positioned at the center of the upper ball passage in the lower housing 42. Thus, the ball can pass through the upper ball passage. However, as shown in FIG. 6, the center of the lower ball passage in the lower housing 42 is shifted from the center of the upper ball passage. Thus, the ball contacts the shoulder of the lower ball passage and will not drop from the lower housing (FIG. 6B).

Figure 6A:
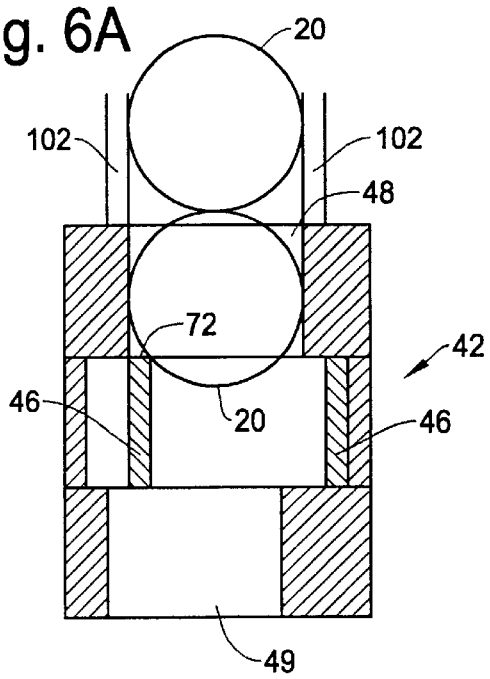
FIG. 6A, FIG. 6B and FIG. 6C, respectively, are cross section views of the ball stopper ring and its positional relationship in the lower housing in the spherical object drop mechanism for game apparatus of the present invention.
Figure 6B:
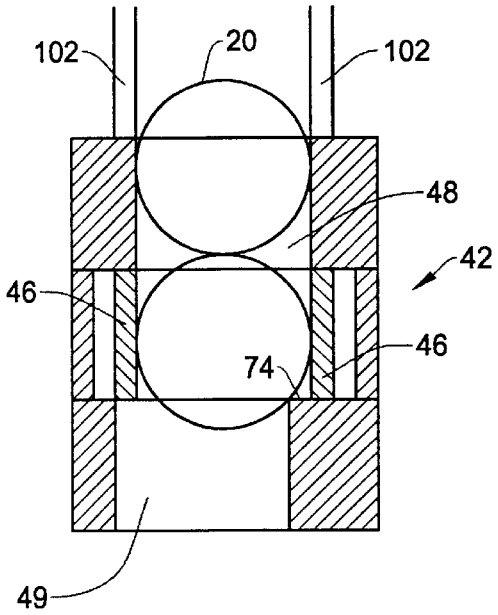
Figure 6C:
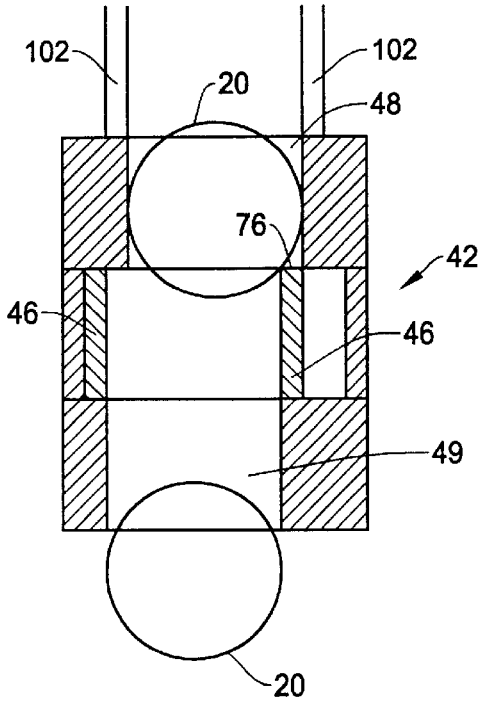

When the ball stopper ring 46 rotates further by the movement of the lever 180, and its center and the center of the lower ball passage match with one another, the ball drops on the ground (FIG. 6C). When the user releases the lever 180, the lever automatically returns to the position shown in FIG. 4A and FIG. 5A.

FIGS. 6A–6C are schematic cross sectional views of the ball stopper ring 46 seen from the side of the lower housing 42. FIGS. 6A–6C more clearly show the movements of the spherical object drop mechanism 50 for game apparatus of the present invention described above with reference to FIGS. 4 and 5. Simply stated, the spherical object drop mechanism 50 is configured to drop the lowermost ball on the ground while preventing the balls above the lowermost ball from dropping at the same time.

The ball 20 is introduced to the lower housing 42 through the ball guide 102. As shown in FIG. 4 and FIG. 5, the drive part (shaft) 182 is rotated by the operation of the lever 180. Accordingly, the ball stopper ring 46 rotates about the drive part 182. As a consequence, the ball stopper ring 46 moves in a horizontal direction in the inner space of the lower housing 42.

The upper ball passage 48 and the lower ball passage 49 are respectively formed in the lower housing 42. Both of the upper ball passage 48 and the lower ball passage 49 have the inner diameter that is slightly larger than the outer diameter of the ball 20. Thus, the ball can pass though the passages. As shown in FIG. 6, the center of the upper ball passage 48 and the center of the lower ball passage 49 are slightly displaced from each other. Thus, the movement of the ball toward the lower position is determined by the position of the ball stopper ring 46.

FIG. 6A shows the situation where the lever 180 is not rotated. In this condition, the ball stopper ring 46 is positioned at the right side in the lower housing 42 due to the spring force of the spring 54. The center of the ball stopper ring 46 is shifted from the center of the upper ball passage 48. Thus, the ball 20 contacts the upper left portion 72 of the ball stopper ring 46, thus is prevented from moving downward.

FIG. 6B shows the situation where the user pulled the lever 180. In this condition, the ball stopper ring 46 moves toward the left in the lower housing, and its center is positioned at the center of the upper ball passage 48 in the lower housing 42. As described above, the inner diameter of the ball stopper ring 46 is just about enough to pass the ball 20 therethrough. Thus, the ball 20 drops through the ball stopper ring 46. However, since the center of the lower ball passage 49 is shifted from that of the upper ball passage 48, the ball 20 contacts the right shoulder 74 of the lower ball passage 49. Thus, the ball 20 will not drop from the lower housing 42.

FIG. 6C shows the condition wherein the user further rotates the lever 180, which further moves the ball stopper ring toward the left. Thus, the center of the ball stopper ring 46 matches the center of the lower ball passage 49. Thus, the lowermost ball 20 drops to the ground due to the gravity. The upper ball 20 that is positioned above the lowermost ball 20 contacts the right upper portion 76 of the ball stopper ring 46. Thus, the upper ball 20 cannot move toward the lower position. As a result of the above noted operations, the user can drop the ball 20 on a desired spot on the ground every time when pulling the lever 180.

Figure 7:
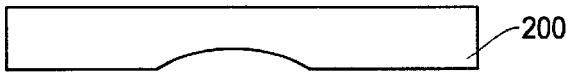
FIG. 7 is a top view showing an example of the lock bar used in the spherical object drop mechanism for game apparatus of the present invention.

The lock mechanism in the spherical object drop mechanism 50 for game apparatus of the present invention is explained with reference to FIG. 7 to FIG. 9. FIG. 7 shows the lock bar 200 used in the lock mechanism of the present invention. As shown in FIG. 7, the lock bar 200 has a semicircular depression at the middle portion. This depression is so formed that it almost matches the outer curve of the ball to be inserted.

Figure 8A:
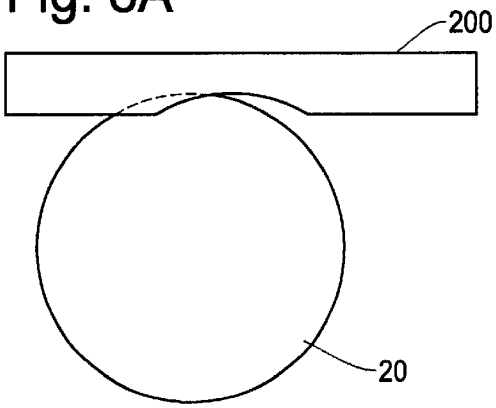
FIG. 8A and FIG. 8B are schematic diagrams showing the positional relationship of the lock bar and the ball shown in FIG. 7 used in the spherical object drop mechanism for game apparatus of the present invention.
Figure 8B:
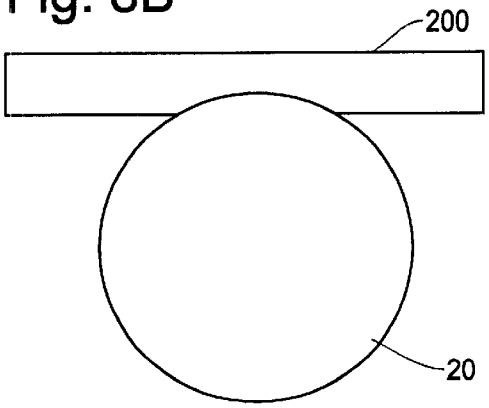

FIGS. 8A and 8B show the relationship between the lock bar 200 and the ball 20. The lock bar 200 is mounted on the upper support 114 in such a way to be projected from the inner wall of the ball insertion opening 120 of the upper support 114. The lock bar 200 is slidably mounted on the upper support 114. Thus, the user can slide the lock bar 200 as desired in the right or left direction.

FIG. 8A shows the situation wherein the ball 20 is locked in the upper support. This condition is effectively used to prevent the balls from dropping out of the insertion opening 120 when, for example, a user carries the spherical object drop mechanism 50 after storing the balls, or a user is using the game apparatus with the drop mechanism 50. As shown in FIG. 8A, the ball 20 does not correspond to the position of the depression of the lock bar. Thus, the ball 20 does not drop out from the drop mechanism.

FIG. 8B shows the situation where the ball 20 is not locked in the upper support. This condition is effectively used when, for example, the user inserts the balls from the insertion opening 120 to the ball guide 102, or when the user wants to take out the ball from the insertion opening 120. As shown in FIG. 8B, the depression of the lock bar 20 and the ball 20 match with one another. Thus, the ball 20 can freely pass through the insertion opening 120.

Figure 9A:
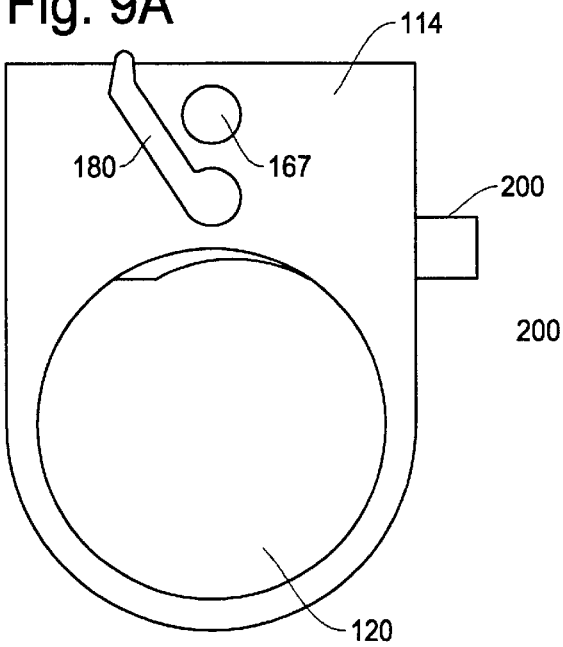
FIG. 9A and FIG. 9B are schematic diagrams showing the positional relationship of the lock bar provided in the upper support in the spherical object drop mechanism for game apparatus of the present invention.
Figure 9B:
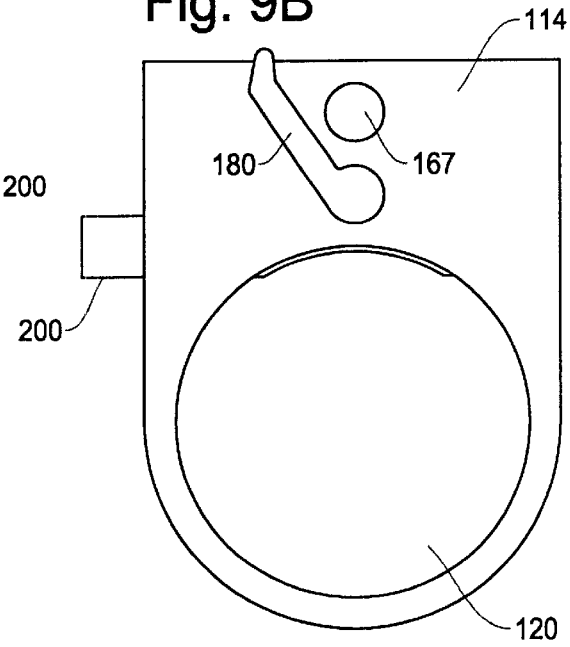

FIGS. 9A and 9B are top views of the upper support 114 showing the movements of the lock mechanism described above. The conditions of the lock bar 200 in FIGS. 9A and 9B correspond to those in FIGS. 8A and 8B. In FIGS. 9A and 9B, there is shown the relationship between the inner surface of the ball insertion opening 120 of the upper support 114 and the depression of the lock bar 200.

FIG. 9A shows the condition where the user slides the lock bar 200, and the outer diameter of the ball, i.e., the inner surface of the ball insertion opening 120, does not match the depression of the lock bar 200. Thus, the ball 20 cannot freely move due to the lock mechanism.

FIG. 9B shows the situation where the user slides the lock bar 200 to the direction opposite to the situation above, and outer diameter of the ball, i.e., the inner surface of the ball insertion opening 120, matches the depression of the lock bar 200. Since the depression of the lock bar 200 is formed so that the balls can pass through as described above, the balls can move freely.

Figure 12A:
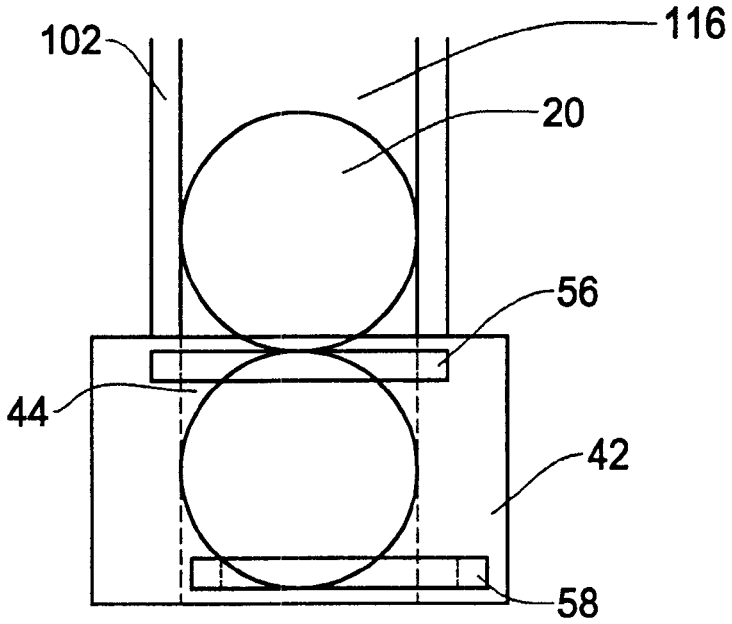
FIG. 12A and FIG. 12B are cross sectional views showing the movement and its positional relationship between the upper stopper ring and the lower stopper ring in the lower housing in the spherical object drop mechanism for game apparatus in the modified version of the present invention.
Figure 12B:
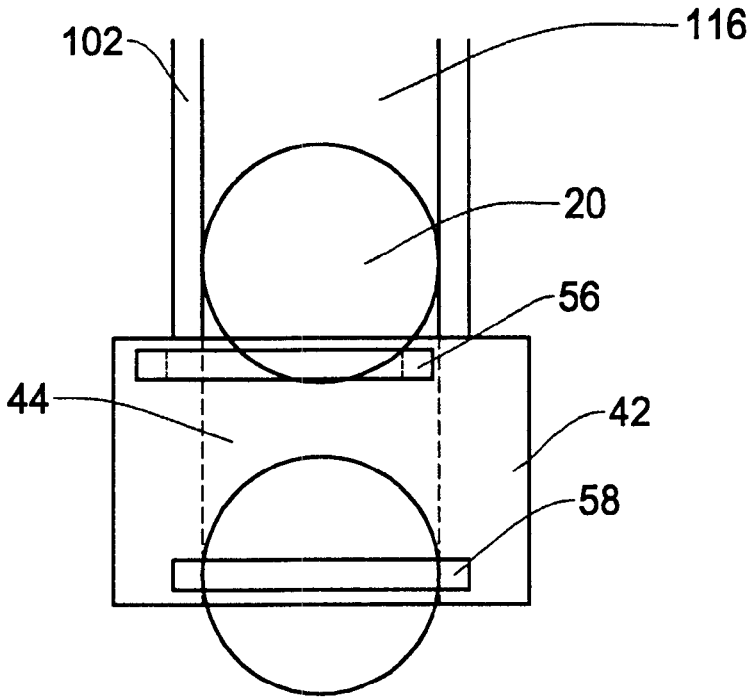
Figure 13:
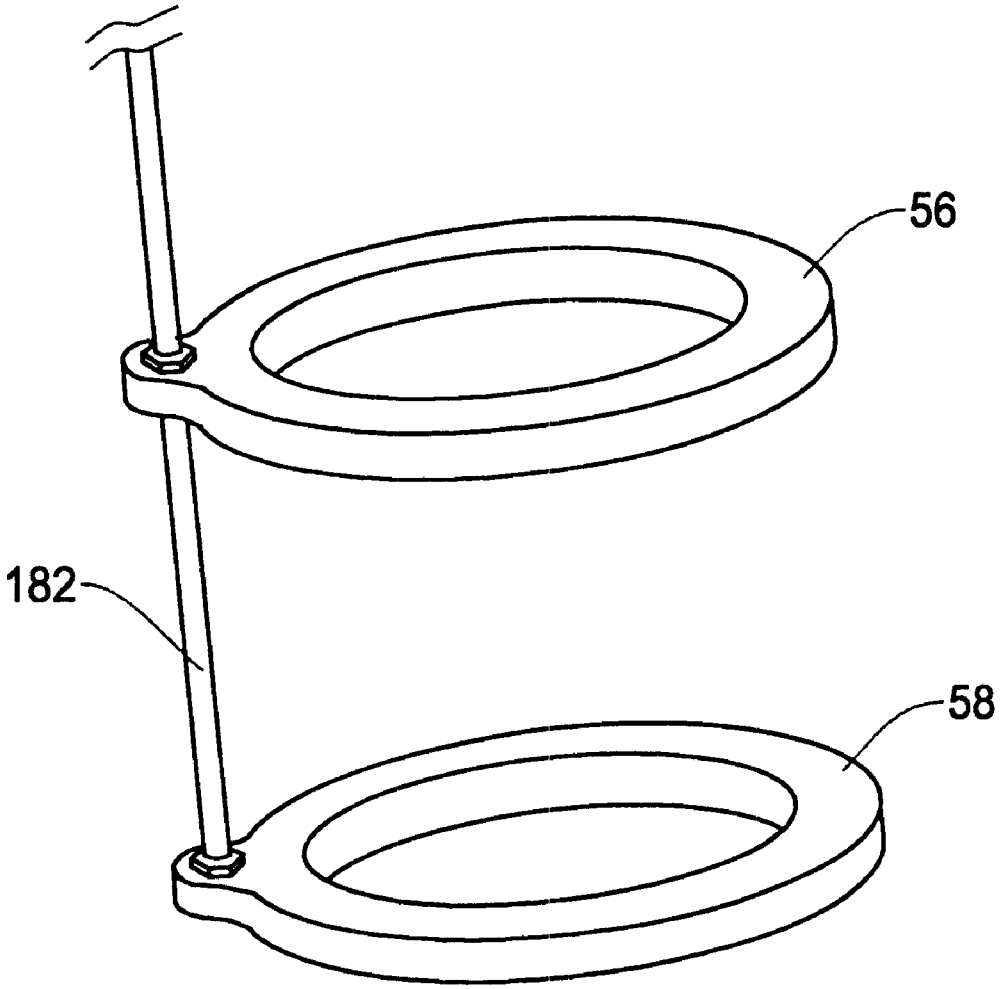
FIG. 13 is the perspective view of the drive part and the upper and lower ball stopper rings in the spherical object drop mechanism for game apparatus in the modified version of the present invention.

FIG. 10 to FIG. 13 show a modified example of the spherical object drop mechanism of the present invention. In this example, the ball stopper mechanism is comprised of the upper ball stopper ring 56 and the lower ball stopper ring 58. FIG. 13 is a perspective view showing the outer appearance of the ball stopper mechanism. The ball stopper mechanism is installed in the ball passage 44 (FIG. 12) in the lower housing. Unlike the example shown in FIG. 4 through FIG. 6, the ball passage 44 in FIG. 12 does not have the positional shifts of its center.

The upper ball stopper ring 56 and the lower ball stopper ring 58 are vertically distanced by a size of about one ball. As will be explained later, the upper ball stopper ring 56 and the lower ball stopper ring 58 are angled differently relative to the drive part (shaft) 182.

Like the embodiment shown in FIG. 4 to FIG. 6, the ball stopper mechanism functions to prevent the balls above the lowermost ball from dropping when the lowermost ball is dropped downward. Thus, when the user operates the lever 180, the lowermost ball drops on the ground, and when the user releases the lever 180, the next ball is moved downward to the position where the lowermost ball was before and is stayed in the position.

Figure 10A:
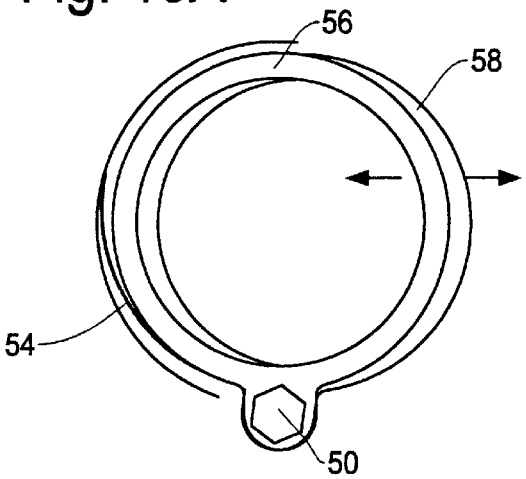
FIG. 10A and FIG. 10B are schematic diagrams showing the operation and its positional relationship of the upper and lower ball stopper rings in the modified version of the spherical object drop mechanism for game apparatus of the present invention.
Figure 10B:
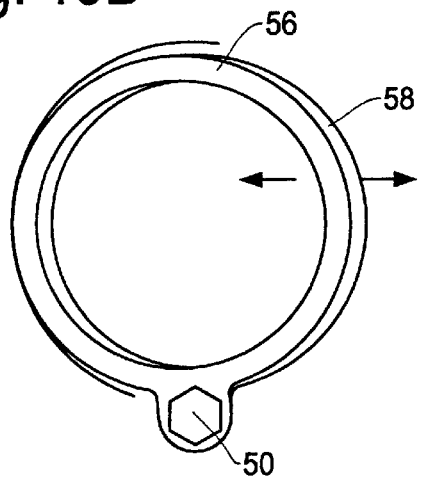
Figure 11A:
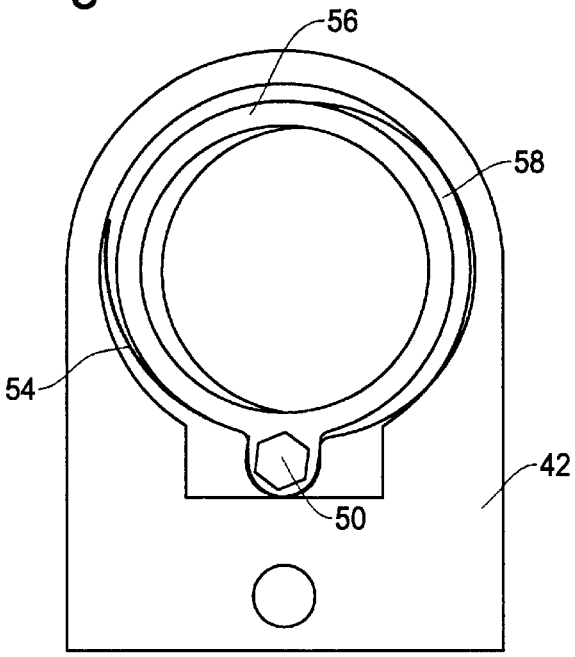
FIG. 11A and FIG. 11B are schematic diagrams showing the movement and its positional relationship of the upper stopper ring and the lower stopper ring stored in the lower housing in the spherical object drop mechanism in the modified version of FIG. 10.
Figure 11B:
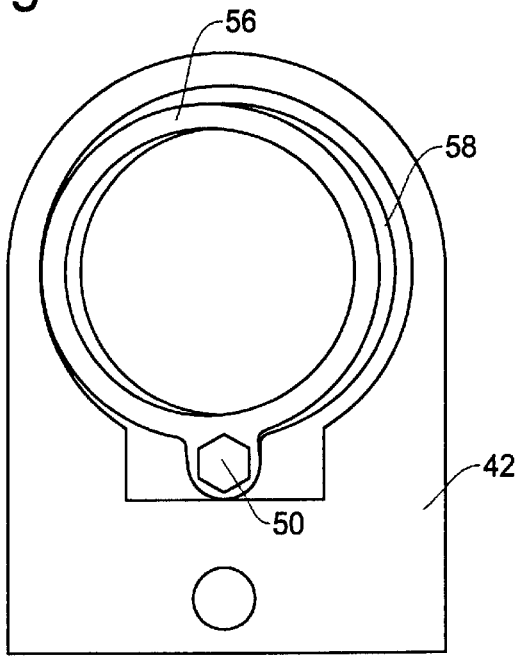

As shown in FIG. 10 and FIG. 11, the upper ball stopper ring 56 and the lower ball stopper ring 58 are angled differently relative to the drive part 182 (bolt 50). The upper ball stopper ring 56 and the lower ball stopper ring 58 respectively have the inner diameter which is larger than the outer diameter of the ball 20. Thus, when the center of the ball passage 44 of the lower housing 42 and the center of each of the ball stopper rings match, the ball 20 passes through the ball stopper rings.

When the user operates the lever 180, the rotational movement is transmitted through the drive part 182 to the upper ball stopper ring 56 and the lower ball stopper ring 58. As shown in FIG. 10 and FIG. 11, the ball stopper rings move horizontally in right and left. Thus, the centers of the ball stopper rings move right and left, thereby controlling the balls in dropping or stopping in the drop mechanism. When the ball 20 that is intended to be dropped drops to the ground, the balls above the ball 20 that has dropped is prevented from dropping because it is obstructed by the upper ball stopper ring 56. Thus the other balls will not drop from the drop mechanism. Accordingly, the drop mechanism of the invention prevents two or more balls from dropping to the ground at the same time.

FIGS. 12A and 12B show the movements of the upper ball stopper ring 56 and the lower ball stopper ring 58 in the lower housing of the spherical object drop mechanism of the present invention. FIGS. 12A and 12B are cross sectional views seen from the side of the lower housing. In FIG. 12, the dotted lines on the upper ball stopper ring 56 and the lower ball stopper ring 58, respectively indicate the inner circular wall (inner diameter) of the ball stopper rings. The ball 20 is introduced to the lower housing 42 through the ball guide 102.

FIG. 12A shows the situation where the lever 180 is not operated by the user. In this condition, the upper ball stopper ring 56 and the lower ball stopper ring 58 are positioned at predetermined default positions. In this default positions, the center of the upper ball stopper ring 56 is positioned so as to match the center of the ball passage 44. Thus, as shown in the drawings, the ball 20 passes through the upper ball stopper ring 56. However, since the center of the lower ball stopper ring 58 and the center of the ball passage 44 do not match with one another, the ball 20 contacts the lower ball stopper ring 46, and is not able to drop to the ground.

FIG. 12B shows the situation where the lever 180 is pulled by the user. In this condition, the center of the lower ball stopper ring 58 and the center of the ball passage 44 match with one another. Thus, the lowermost ball 20 drops on the ground. Since the center of the upper ball stopper ring 56 does not match the center of the ball passage 44, the next ball 20 is prevented by the upper ball stopper ring 56 and is not dropped to the ground.

FIG. 13 is a perspective view of the variation of the spherical object drop mechanism of the present invention described with reference to FIG. 10 to FIG. 12. It is comprised of the drive part (shaft) 182, the upper ball stopper ring 56, and the lower ball stopper ring 58. This variation is suitable for miniaturizing the lower housing 42 since the thickness of the upper and lower stopper rings 56 and 58 can be decreased.

Figure 14A:
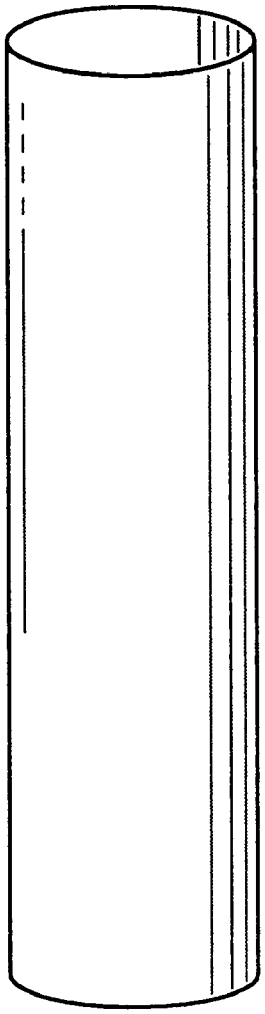
FIG. 14A and FIG. 14B are front views showing other examples of the ball guide used in the spherical object drop mechanism for game apparatus of the present invention.
Figure 14B:
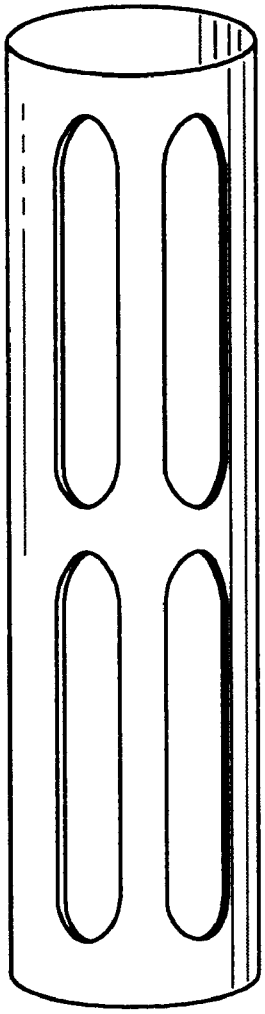

FIGS. 14A and 14B are front views showing examples of other configurations of the ball guide used in the spherical object drop mechanism for the game apparatus of the present invention. The ball guide can be configured in various ways, and FIGS. 14A and 14B show merely examples. In the example of FIG. 14A, the ball guide is configured by transparent plastic material. In the example of FIG. 14B, the ball guide is configured by non-transparent plastic material with slits for viewing the inner condition.

Since the spherical object drop mechanism of the present invention is configured by a simple structure, it can achieve high reliability, ease of production, and less need of maintenance. Accordingly, it is able to produce the spherical object drop mechanism of the present invention at low cost, light-weight, and strong.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. A spherical object drop mechanism for game apparatus, comprising:

a spherical object guide to store a plurality of spherical objects to be movable in a vertical direction by their own weight;

an upper support provided at an upper portion of said spherical object guide;

a lower housing provided at a lower portion of said spherical object guide;

a ball stopper ring provided in said lower housing to stop and release the movement of the spherical object in the vertical direction;

a drive part to stop and release the movement of the spherical object by said ball stopper ring; and a lever to operate said drive part from outside.

2. A spherical object drop mechanism for game apparatus as defined in claim 1, wherein, when said lever is not operated, said ball stopper ring is positioned to one of inner sides of said lower housing to prevent said vertical movement of said spherical object.

3. A spherical object drop mechanism for game apparatus as defined in claim 1, wherein, when the upper lever is operated, said ball stopper ring moves in a horizontal direction within said lower housing to allow the vertical movement of said spherical object.

4. A spherical object drop mechanism for game apparatus as defined in claim 1, wherein an upper ball passage and a lower ball passage are formed in said lower housing, and a center of the upper ball passage and a center of the lower ball passage are displaced from each other, and a space is provided between the upper ball passage and lower ball passage to allow horizontal movement of said ball stopper ring based on the operation of said lever.

5. A spherical object drop mechanism for game apparatus as defined in claim 4, wherein, when the upper lever is not operated, the spherical object is prevented from moving downward by said ball stopper ring, and when said lever is moved and thus the ball stopper ring is moved in the horizontal direction in said space so that the center of said ball stopper ring matches the center of said upper ball passage, the spherical object moves downward through the ball stopper ring, and when said lever is further moved and thus said ball stopper ring is moved further in the horizontal direction in said space so that the center of the ball stopper ring matches the center of said lower ball passage, the spherical object drops to the ground through the lower ball passage.

6. A spherical object drop mechanism for game apparatus as defined in claim 4, wherein, when said lever is operated and the center of the ball stopper ring matches the center of the lower ball passage to drop said spherical object to the ground, the spherical object above the dropped spherical object is prevented from moving downward by said ball stopper ring.

7. A spherical object drop mechanism for game apparatus as defined in claim 1, wherein said drive part rotates when said lever is operated, and transmits the rotational movement to said ball stopper ring.

8. A spherical object drop mechanism for game apparatus as defined in claim 1, wherein a spring is mounted on said lower housing for said ball stopper ring so that the spring force of said spring automatically returns said ball stopper ring to a default condition when a user releases said lever.

9. A spherical object drop mechanism for game apparatus as defined in claim 1, wherein said upper support includes a ball insertion opening to supply a spherical object to said spherical object guide, and a lock mechanism located near said ball insertion opening to prevent said spherical object from being dropped.

10. A spherical object drop mechanism for game apparatus, comprising:

a spherical object guide to store a plurality of spherical objects to be movable in a vertical direction by their own weight;

an upper support provided at an upper portion of said spherical object guide;

a lower housing provided at a lower portion of said spherical object guide for forming a ball passage in the vertical direction;

a ball stopper mechanism provided in said lower housing to stop and release the movement of the spherical object in the vertical direction, said ball stopper mechanism being formed of an upper ball stopper ring and a lower ball stopper ring;

a drive part to stop and release the spherical object by said ball stopper mechanism; and a lever to operate said drive part from outside.

11. A spherical object drop mechanism for game apparatus as defined in claim 10, wherein, in a default condition where said lever is not operated, said ball stopper mechanism is located in a predetermined position in said lower housing, and a center of the upper ball stopper ring matches a center of said ball passage, and a center of said lower ball stopper ring does not match the center of said ball passage.

12. A spherical object drop mechanism for game apparatus as defined in claim 10, wherein, in a condition where said lever is operated, said ball stopper mechanism moves horizontally in said lower housing, and a center of the lower ball stopper ring matches a center of said ball passage, and a center of said upper ball stopper ring does not match the center of said ball passage.

13. A spherical object drop mechanism for game apparatus as defined in claim 10, wherein said drive part rotates when said lever is operated, and transmits the rotational movement to said ball stopper mechanism.

14. A spherical object drop mechanism for game apparatus as defined in claim 10, wherein a spring is mounted in said lower housing for said ball stopper mechanism so that the spring force automatically returns said ball stopper mechanism to a default condition when a user releases said lever.

15. A spherical object drop mechanism for game apparatus as defined in claim 10, wherein said upper support includes a ball insertion opening to supply a spherical object to said spherical object guide, and a lock mechanism located near said ball insertion opening to prevent said spherical object from being dropped.

* * * * *